US011623454B2

(12) United States Patent
Bridges et al.

(10) Patent No.: US 11,623,454 B2
(45) Date of Patent: Apr. 11, 2023

(54) COMMON GUTTER SENSING

(71) Applicant: Domino UK Limited, Cambridge (GB)

(72) Inventors: Richard Thomas Calhoun Bridges, Cambridge (GB); Colin Jon Partridge, Cambridge (GB)

(73) Assignee: Domino UK Limited

( * ) Notice: Subject to any disclaimer, the term of this patent is extended or adjusted under 35 U.S.C. 154(b) by 48 days.

(21) Appl. No.: 17/269,785

(22) PCT Filed: Aug. 3, 2019

(86) PCT No.: PCT/GB2019/000111
§ 371 (c)(1),
(2) Date: Feb. 19, 2021

(87) PCT Pub. No.: WO2020/039154
PCT Pub. Date: Feb. 27, 2020

(65) Prior Publication Data

US 2021/0237464 A1 Aug. 5, 2021

(30) Foreign Application Priority Data

Aug. 20, 2018 (GB) ..... 1813503

(51) Int. Cl.
*B41J 2/185* (2006.01)
*B41J 2/125* (2006.01)
*B41J 2/03* (2006.01)

(52) U.S. Cl.
CPC ..... *B41J 2/185* (2013.01); *B41J 2/125* (2013.01); *B41J 2002/033* (2013.01)

(58) Field of Classification Search
CPC ..... B41J 2/02; B41J 2/1721; B41J 2/18; B41J 2/185; B41J 2/1714; B41J 2/125; B41J 2002/033; B41J 2002/1728; B41J 2002/1735; B41J 2002/1742; B41J 2002/1853
See application file for complete search history.

(56) References Cited

U.S. PATENT DOCUMENTS 4,296,418 A 10/1981 Yamazaki et al.
4,410,895 A 10/1983 Houston et al.
4,442,440 A 4/1984 Eichinger
(Continued)

FOREIGN PATENT DOCUMENTS

GB 2455775 A 6/2009
GB 2467100 A 7/2010
(Continued)

*Primary Examiner* — Kristal Feggins
(74) *Attorney, Agent, or Firm* — Price Heneveld LLP

(57) ABSTRACT

A continuous inkjet printer (5) having a printhead (7) that includes first and second ink droplet generators (8, 9), each operable to generate a stream (10) of ink droplets, and a common gutter (11) arranged to receive unprinted ink droplets from the first and second ink droplet generators (8, 9), the printer (5) further including control means configured to determine receipt into the common gutter (11) of ink droplets from the first and second ink droplet generators (8, 9), wherein the control means are operable to use a single sensor (17) to determine receipt into the common gutter (11) of ink droplets from one, both, or neither of the first and second ink droplet generators (8, 9).

6 Claims, 2 Drawing Sheets

(56) References Cited

U.S. PATENT DOCUMENTS

| | | | | |
|---|---|---|---|---|
| 4,661,822 | A * | 4/1987 | Hirota | B41J 2/175 347/89 |
| 4,746,929 | A * | 5/1988 | Lin | B41J 2/025 310/356 |
| 4,797,688 | A | 1/1989 | Furukawa | |
| 2017/0197406 | A1* | 7/2017 | Smith | B41J 2/185 |

FOREIGN PATENT DOCUMENTS

| | | | |
|---|---|---|---|
| GB | 2479751 | A | 10/2011 |
| JP | S6083849 | A | 5/1985 |
| JP | S6179670 | A | 4/1986 |
| JP | 2014065203 | A | 4/2014 |

* cited by examiner

COMMON GUTTER SENSING

FIELD OF THE INVENTION

This invention relates to a continuous inkjet printer that has first and second ink droplet generators and a common gutter arranged to receive ink droplets from the first and second ink droplet generators.

BACKGROUND TO THE INVENTION

Continuous inkjet ('CIJ') Can printers are widely used to place identification codes on products. Typically a CIJ printer includes a printer housing that contains a system for pressurising ink. Once pressurised, the ink is passed, via an ink feed line through a conduit, to a printhead. At the printhead the pressurised ink is passed through a nozzle of an ink droplet generator to form an ink jet. A vibration or perturbation is applied by the droplet generator to the ink jet causing the jet to break into a stream of droplets.

The printer includes a charge electrode to charge selected droplets, and electrostatic deflection means to deflect the charged droplets away from their original trajectory and onto a substrate. By controlling the amount of charge that is placed on droplets, the trajectories of those droplets can be controlled to form a printed image.

A CIJ printer is so termed because the printer forms a continuous stream of droplets irrespective of whether or not any particular droplet is to be used to print. The printer selects the drops to be used for printing by applying a charge to those drops, unprinted drops being allowed to continue, on the same trajectory as they were jetted from the nozzle, into a gutter. The unprinted drops collected in the gutter are returned from the printhead to the printer housing via a gutter line included in the same conduit as contains the pressurised ink feed line feeding ink to the printhead. Ink, together with entrained air, is generally returned to the printer housing under vacuum, the vacuum being generated by a pump in the gutter line.

At the start-up of a CIJ printer, ink droplets are ejected from the droplet generator into the gutter whilst pressure (vacuum) within the gutter line is monitored. This allows any misalignment between the droplet generator and the gutter to be identified.

Some embodiments of CU printer include first and second ink droplet generators aligned with a common gutter, an example of such a printer being described in UK Patent No. GB 2 467 100. With such printers, the start-up routine requires the alignment of each droplet generator to be checked and this has been achieved, in the past, using a resistive sensor in the ink path for each droplet generator. The use of a sensor for each droplet generator inevitably adds cost to the printer. In addition, the use of resistive sensors necessitates a higher electrical conductivity of the ink than would otherwise be required to enable charging of droplets of the ink, which higher electrical conductivity can cause reliability problems, e.g., due to short circuits between ink deposits in the printhead.

SUMMARY OF THE INVENTION

Accordingly the invention provides a continuous inkjet printer having a printhead that includes first and second ink droplet generators, each operable to generate a stream of ink droplets, and a common gutter arranged to receive unprinted ink droplets from the first and second ink droplet generators, the printer further including control means configured to determine receipt into the common gutter of ink droplets from the first and second ink droplet generators, wherein the control means are operable to use a single sensor to determine receipt into the common gutter of ink droplets from one, both, or neither of the first and second ink droplet generators.

Preferably the control means are configured to identify at least one characteristic of ink flow through a gutter line connected to the common gutter, the at least one characteristic being associated with receipt into the common gutter of ink from one, both, or neither of the first and second ink droplet generators.

Preferably the control means are configured to identify the at least one characteristic of ink flow as the first and then the second ink droplet generator are brought into operation in sequence.

Preferably the single sensor is a pressure sensor and the at least one characteristic comprises a pressure level and/or a rate of change of a pressure level in the gutter line connected to the common gutter.

Preferably the control means are configured to determine receipt into the common gutter of ink droplets from the first ink droplet generator by identifying using the pressure sensor a first substantially stable pressure level in the gutter line, and to determine receipt into the common gutter of ink droplets from the first and second droplet generators by identifying using the pressure sensor a second substantially stable pressure level in the gutter line after identification of the first substantially stable pressure level in the gutter line.

Preferably the control means are configured to report a fault and/or to shut down the printer in the event the first substantially stable pressure or the second substantially stable pressure is not identified.

BRIEF DESCRIPTION OF THE DRAWINGS

The invention will now be described, by way of example, with reference to the attached drawing figures, in which.

DETAILED DESCRIPTION OF EMBODIMENT

Figure 1:
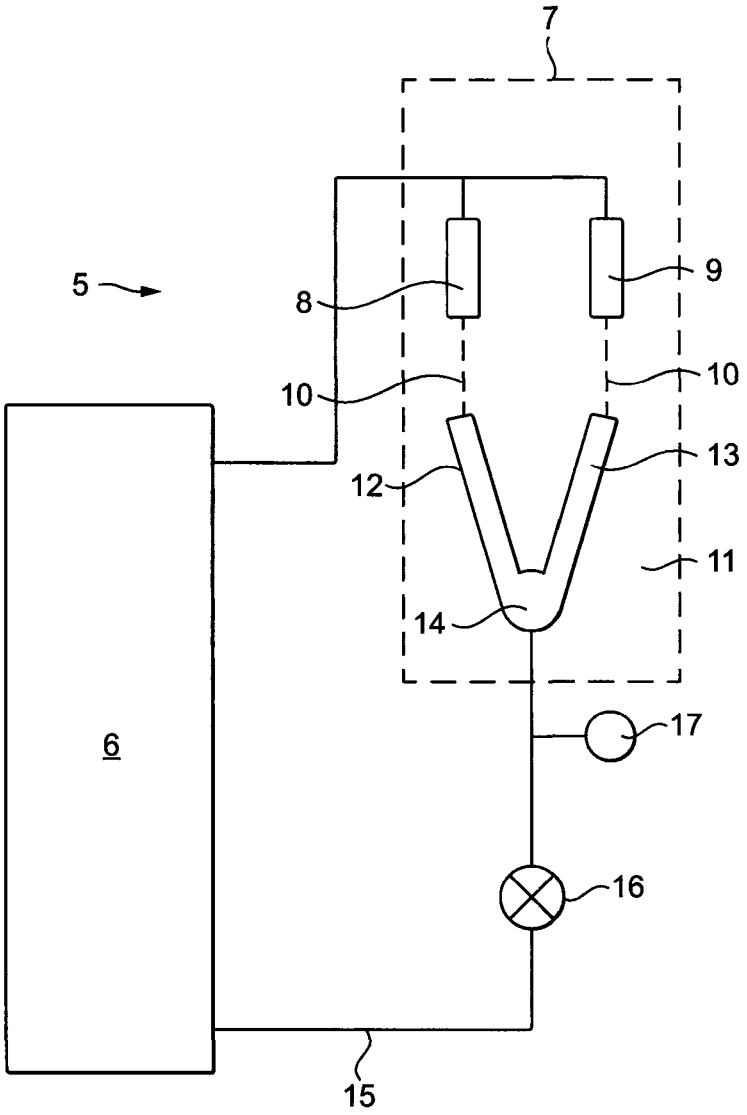
FIG. 1 is a schematic diagram of a CIJ printer in accordance with the invention.

Referring to FIG. 1, the invention provides a CIJ printer 5 having a printer housing indicated generally by 6 and a printhead indicated in dotted outline at 7. In the conventional manner the printer housing 6 contains an ink system including a system pump, printer drive and control electronics, and ink and make-up reservoirs. In the known manner ink is fed by the system pump, under pressure, to the printhead. In this particular embodiment the printhead includes first and second ink droplet generators 8 and 9, each of which, in the conventional manner, emits a jet of ink. Each jet is broken into a stream of droplets 10 by applying a vibration or perturbation to the jet.

A gutter 11 is provided to capture unprinted ink droplets. In the form shown the gutter comprises a first arm 12 positioned to receive unprinted drops from the first ink droplet generator 8, a second arm 13 positioned to receive unprinted droplets from the second ink droplet generator 9, and a collection chamber 14 in which ink from the arms 12 and 13 collects. A gutter line 15 leads from the collection chamber 14 to convey unprinted ink back to the ink reservoir in the printer housing 6. This is achieved by means of a vacuum pump 16. A pressure sensor 17 measures vacuum within the gutter line and therefore generates a control input for the printer control electronics.

Figure 2:
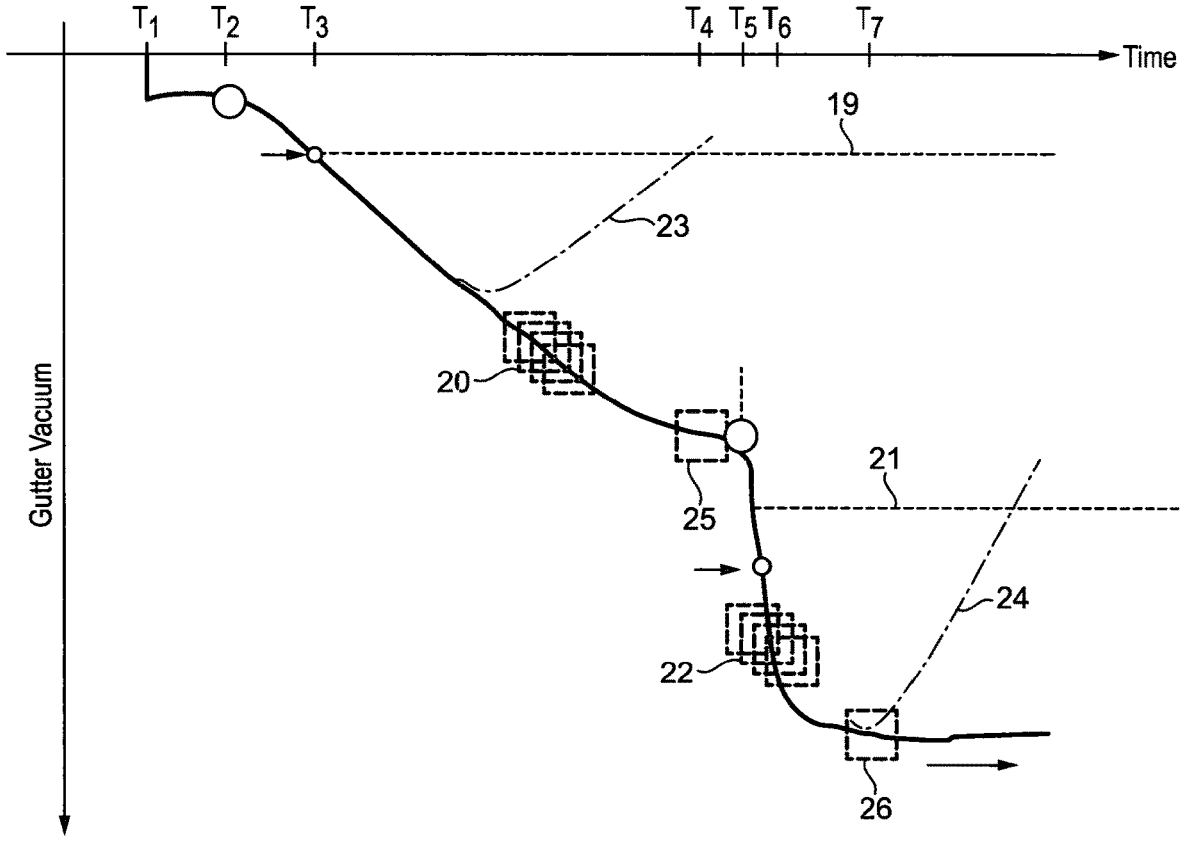
FIG. 2 is a schematic plot of flow characteristics observed during the operation of such a CIJ printer.

Turning now to FIG. 2, the invention has been devised to provide a dual jet CIJ printer which, on start-up, can rapidly assume a ready-to-print status using only a single sensor to determine that ink from both of the first and second ink droplet generators 8 and 9 is being received in the gutter 11. In this particular embodiment, this is achieved by observing pressure characteristics of the ink and air flow through the gutter line 15 using the pressure sensor 17.

At T1 in FIG. 2 the pump 16 is turned on and draws a partial vacuum in the gutter line 15. The vacuum level in the gutter line is relatively low, i.e., the pressure at the pressure sensor 17 is relatively high, albeit below atmospheric pressure, because at start-up the gutter line is clear and there is a free flow of air through the gutter line.

At T2 the first ink droplet generator 8 is turned on, which causes a stream of ink droplets to be directed towards the arm 12 of the gutter 11. If the first ink droplet generator is operating correctly, the stream of ink droplets enters the arm 12 and the vacuum level in the gutter line starts to increase, i.e., the pressure at the pressure sensor 17 starts to decrease, because the ink droplets entering the arm 12 restrict the flow of air through the gutter line.

The vacuum level in the gutter line continues to increase until the pressure at the pressure sensor falls at T3 below a first predetermined level (denoted by reference numeral 19) of, say, 20% below atmospheric pressure. The printer control electronics identify the pressure at the pressure sensor falling below the first predetermined level 19 as indicative that the first ink droplet generator is operating correctly and directing the stream of ink droplets into the arm 12 of the gutter.

Between T3 and T4 the vacuum level in the gutter line continues to increase. The printer control electronics monitor the rate of change of the vacuum level in the gutter line by storing pressure measurements from the pressure sensor in a rolling buffer, represented in FIG. 2 by reference numeral 20.

The printer control electronics identify the rate of change of the vacuum level rising and remaining for a predetermined time above a predetermined threshold level (the rate of change of the vacuum level initially being negative), the identification being denoted in FIG. 2 by reference numeral 25, as indicative that the first droplet generator continues to operate correctly and that the pump 16 has reached a steady state of operation.

Had the rate of change of the vacuum level become positive, or the pressure at the pressure sensor risen above the first predetermined level 19, as illustrated by the broken line denoted by reference numeral 23 in FIG. 2, the printer control electronics would have identified this behaviour as indicative that the first droplet generator 8 had ceased operating correctly and was no longer directing the stream of ink droplets into the arm 12 of the gutter. In this circumstance, which might arise if the nozzle of the first droplet generator 8 became partially blocked, the printer control electronics would shut down the printer.

At 15, assuming that correct operation of the first ink droplet generator 8 has been identified, the second ink droplet generator 9 is turned on, which causes a stream of ink droplets to be directed towards the arm 13 of the gutter 11. If the second ink droplet generator is operating correctly, the stream of ink droplets enters the arm 13 and the vacuum level in the gutter line starts to increase again, i.e., the pressure at the pressure sensor 17 starts to decrease further, because the ink droplets entering the arm 13 further restrict the flow of air and ink droplets from the first ink droplet generator through the gutter line.

The vacuum level in the gutter line continues to increase until at T6 the pressure at the pressure sensor falls below a second predetermined level (denoted by reference numeral 21) of, say, 20% below the steady state pressure identified at T5. The printer control electronics identify the pressure at the pressure sensor falling below the second predetermined level 21 as indicative that both the first and second ink droplet generators are operating correctly and directing their respective streams of ink droplets into the arms 12 and 13 of the gutter.

Between T6 and T7 the vacuum level in the gutter line continues to increase. The printer control electronics monitor the rate of change of the vacuum level in the gutter line by storing pressure measurements from the pressure sensor in the rolling buffer, represented in FIG. 2 by, reference numeral 22.

The printer control electronics identify the rate of change of the vacuum level rising and remaining for the predetermined time above the predetermined threshold level, the identification being denoted in FIG. 2 by reference numeral 26, as indicative that both the first and second ink droplet generators continue to operate correctly and that the pump has reached a steady state of operation.

Had the rate of change of the vacuum level become positive, or the pressure at the pressure sensor risen above the second predetermined level 21, as illustrated by the broken line denoted by reference numeral 24 in FIG. 2, the printer control electronics would have identified this behaviour as indicative that at least one of the first and second droplet generators 8 and 9 had ceased operating correctly and was no longer directing its stream of ink droplets into the corresponding arm of the gutter. In this circumstance the printer control electronics would shut down the printer.

At T7, assuming that correct operation of both ink droplet generators has been identified, the printer changes its status to ready-to-print.

It will be appreciated that the present invention, at least in the case of the embodiment described, allows rapid priming of the printhead of a dual jet CIJ printer, and rapid identification of jet misalignment, using a single sensor.

It will also be appreciated that the above description relates only to one embodiment of the invention, and that the invention encompasses other embodiments as defined by the claims.

The invention claimed is:

1. A continuous inkjet printer having a printhead that includes first and second ink droplet generators, each operable to generate a stream of ink droplets, and a common gutter arranged to receive unprinted ink droplets from the first and second ink droplet generators, the printer further including control means configured to determine receipt into the common gutter of ink droplets from the first and second ink droplet generators, wherein the control means are operable to use a single sensor to determine receipt into the common gutter of ink droplets from one, both, or neither of the first and second ink droplet generators.

2. A continuous inkjet printer according to claim 1, wherein the control means are configured to identify at least one characteristic of ink flow through a gutter line connected to the common gutter, the at least one characteristic being associated with receipt into the common gutter of ink from one, both, or neither of the first and second ink droplet generators.

3. A continuous inkjet printer according to claim 2, wherein the control means are configured to identify the at least one characteristic of ink flow as the first and then the second ink droplet generator are brought into operation in sequence.

4. A continuous inkjet printer according to claim 2, wherein the single sensor is a pressure sensor and the at least one characteristic comprises a pressure level and/or a rate of change of a pressure level in the gutter line connected to the common gutter.

5. A continuous inkjet printer according to claim 4, wherein the control means are configured to determine receipt into the common gutter of ink droplets from the first ink droplet generator by identifying using the pressure sensor a first substantially stable pressure level in the gutter line, and to determine receipt into the common gutter of ink droplets from the first and second droplet generators by identifying using the pressure sensor a second substantially stable pressure level in the gutter line after identification of the first substantially stable pressure level in the gutter line.

6. A continuous inkjet printer according to claim 5, wherein the control means are configured to report a fault and/or to shut down the printer in the event the first substantially stable pressure or the second substantially stable pressure is not identified.

* * * * *